US008266988B2

(12) United States Patent
Scirbona

(10) Patent No.: US 8,266,988 B2
(45) Date of Patent: Sep. 18, 2012

(54) SPEED WRENCH INCLUDING AN ANGLED OFFSET

(75) Inventor: Edward Scirbona, Danbury, CT (US)

(73) Assignee: Jonard Industries Corp, Tuckahoe, NY (US)

( * ) Notice: Subject to any disclaimer, the term of this patent is extended or adjusted under 35 U.S.C. 154(b) by 330 days.

(21) Appl. No.: 12/656,205

(22) Filed: Jan. 21, 2010

(65) Prior Publication Data

US 2011/0030515 A1 Feb. 10, 2011

Related U.S. Application Data

(60) Provisional application No. 61/273,830, filed on Aug. 10, 2009.

(51) Int. Cl.
*B25B 13/08* (2006.01)

(52) U.S. Cl. ..... 81/119; 81/125.1

(58) Field of Classification Search ..... 81/125.1, 81/119, 186; D8/28
See application file for complete search history.

(56) References Cited

U.S. PATENT DOCUMENTS

| | | | | | |
|---|---|---|---|---|---|
| 956,259 | A | * | 4/1910 | Amborn | 81/119 |
| 1,261,565 | A | * | 4/1918 | Leitner | 81/125.1 |
| 1,535,281 | A | * | 4/1925 | Zilliox | 81/119 |
| 1,764,379 | A | * | 6/1930 | Zilliox | 81/177.8 |
| 1,954,141 | A | | 4/1934 | Miquelon | |
| 2,687,056 | A | * | 8/1954 | Foor | 81/125.1 |
| 3,620,107 | A | | 11/1971 | Evans | |
| 3,757,614 | A | | 9/1973 | Evans | |
| 3,762,244 | A | | 10/1973 | Evans | |
| 3,921,476 | A | | 11/1975 | Evans | |
| 4,167,882 | A | | 9/1979 | Siwersson | |
| 4,776,244 | A | | 10/1988 | Olson | |
| 5,396,820 | A | * | 3/1995 | Baker | 81/177.2 |
| 5,551,322 | A | | 9/1996 | Mikic | |
| 5,582,083 | A | * | 12/1996 | Baker | 81/119 |
| 5,878,636 | A | | 3/1999 | Maker | |
| D410,826 | S | * | 6/1999 | Hsieh | D8/28 |
| D420,873 | S | * | 2/2000 | Hsieh | D8/28 |
| D427,866 | S | * | 7/2000 | Chabot | D8/28 |
| 6,089,127 | A | * | 7/2000 | Dominguez | 81/119 |
| 6,089,131 | A | | 7/2000 | Taimot | |
| 6,186,032 | B1 | * | 2/2001 | Raines | 81/119 |
| 6,269,715 | B1 | | 8/2001 | Cagny | |
| 6,276,240 | B1 | | 8/2001 | Blacklock | |
| 6,289,772 | B1 | | 9/2001 | Ying-Wen | |
| 6,389,934 | B1 | | 5/2002 | Yen | |
| 6,715,383 | B1 | * | 4/2004 | Hsien | 81/119 |
| 6,805,029 | B1 | | 10/2004 | Foster | |
| 7,066,057 | B2 | * | 6/2006 | Hsien | 81/119 |
| 2003/0041700 | A1 | * | 3/2003 | Chen | 81/125.1 |
| 2008/0105093 | A1 | * | 5/2008 | Hart | 81/124.3 |
| 2009/0301270 | A1 | * | 12/2009 | Hart | 81/124.3 |
| 2010/0000378 | A1 | * | 1/2010 | Hart | 81/124.4 |

* cited by examiner

*Primary Examiner* — David B Thomas
(74) *Attorney, Agent, or Firm* — Emdadi Patent Law; Kamran Emdadi

(57) ABSTRACT

A speed wrench is disclosed having at least one recessive portion inside a speed wrench head of the speed wrench, and at least one engaging portion inside the speed wrench head. The speed wrench also has at least one angled portion providing an angled offset measured from a planar surface that the speed wrench is resting on to the center axis of the speed wrench head. The speed wrench may further be double-sided and may be an open-ended wrench.

6 Claims, 1 Drawing Sheet

SPEED WRENCH INCLUDING AN ANGLED OFFSET

CROSS-REFERENCES TO RELATED APPLICATIONS

This application claims the benefit of U.S. Provisional Application No. 61/273,830, filed Aug. 10, 2009 by Edward Scirbona, and entitled "Dual End Speed Wrench."

TECHNICAL FIELD OF THE INVENTION

This invention relates to a wrench apparatus with particular features, more specifically, the wrench apparatus has a speed feature and an angled offset feature.

BACKGROUND OF THE INVENTION

Conventionally, speed wrenches have provided wrench users with a simple and less time-consuming way to either loosen or tighten a bolt or nut (hereinafter an "object" for simplicity). A non-ratcheting wrench or speed wrench is still an important tool used to tighten or loosen an object, especially in instances where a ratchet head cannot be mounted onto an object or in instances where there is limited room to move the ratchet wrench from side-to-side.

A speed wrench may be manufactured to be slimmer and cheaper than a ratchet, and may be fitted into tighter places. Additionally, the speed wrench does not have a rotating mechanism like the ratchet that may fail over time. A speed wrench allows a user to turn the object in one direction, pull the wrench back in the opposite direction without the object turning backwards from the preferred turning direction. Furthermore, this may be accomplished without pulling the wrench off the object and reorienting the head of the wrench onto the object each time the wrench is turned.

A speed wrench by definition is a wrench that provides the wrench user with a way to loosen or tighten an object faster than a traditional wrench. Many different speed wrench head designs exist today. These example speed wrenches have grooves (recessive portions) and teeth (engaging portions) providing the necessary space and engaging portions that may be used to turn an object, rotate the wrench in the opposite direction, and re-engage the object quickly and effectively for the next turn.

Many different speed wrenches have been created offering various different specific features, such as, locations, sizes, quantities, angles and configurations of grooves and teeth. Ideally, a speed wrench could be manufactured without multiple complex angles, quantities of teeth and grooves, and other features specific to the inside area of the wrench head. The design of the speed wrench head may be simple and effective without overcomplicating the specific features of the speed wrench head. In addition, the speediness and user convenience of the speed wrench may be further increased by offering additional features not previously associated with a speed wrench.

SUMMARY OF THE INVENTION

One example embodiment of the present invention may include a speed wrench that includes at least one recessive portion inside a speed wrench head of the speed wrench. The speed wrench may also include at least one engaging portion inside the speed wrench head, and at least one angled portion providing an angled offset measured from a planar surface that the speed wrench is resting on to the center axis of the speed wrench head.

Another example embodiment of the present invention may include a speed wrench that includes at least one recessive means inside a speed wrench head of the speed wrench for avoiding contact with an object. The speed wrench may also include at least one engaging means inside the speed wrench head for contacting an object, and at least one angled means for providing an angled offset measured from a planar surface that the speed wrench is resting on to the center axis of the speed wrench head.

DETAILED DESCRIPTION OF THE INVENTION

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

Figure 1:
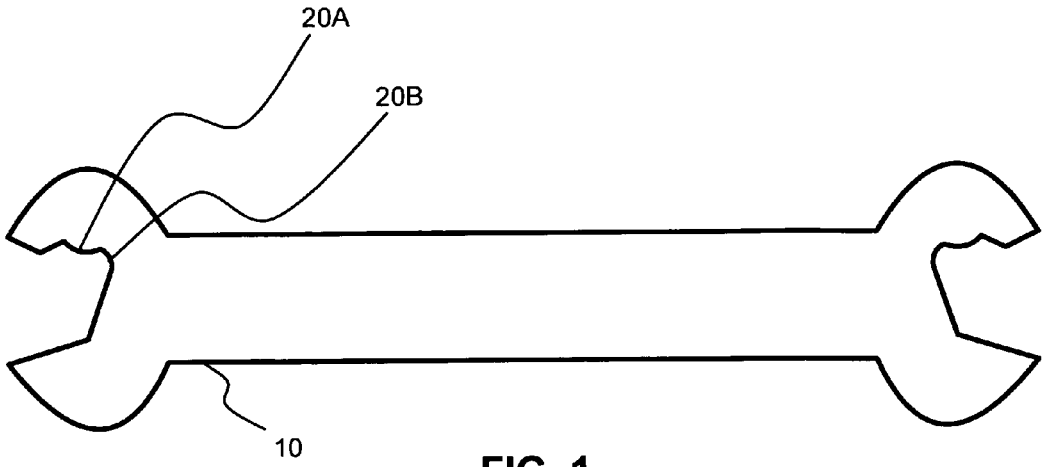
FIG. 1 illustrates a speed wrench, according to example embodiments of the present invention.

FIG. 1 illustrates a view of the speed wrench, according to example embodiments of the present invention. Referring to FIG. 1, an angular offset speed wrench 10 is illustrated as having at least one head engaging portion 20A and at least one head recessive portion 20B. These portions 20A and 20B provide a speed wrench actuation system when operating the speed wrench.

Figure 2:
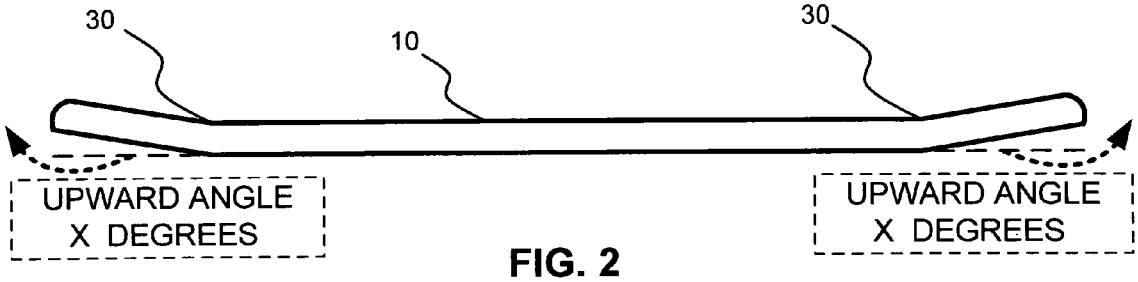
FIG. 2 illustrates a side view perspective of the speed wrench, according to example embodiments of the present invention.

FIG. 2 illustrates a side view of the speed wrench, according to example embodiments of the present invention. Referring to FIG. 2, the speed wrench 10 is illustrated as laying flat on a uniform surface, such as, for example, a table or other flat surface. The speed wrench 10 has an angled head 30 angling upward from the uniform surface. The angle "X" is variable and may be within a range of angular degrees. According to example embodiments of the present invention, the speed wrench angle "X" may be approximately 15 degrees. According to other example embodiments the angle "X" may be any common angle associated with wrench design and manufacture.

Such an angled speed wrench head may provide an additional convenience feature to the user that conventional speed wrenches do not provide. For example, conventional open-ended speed wrenches may be limited to a particular range of motion that any user of the wrench must accept. However, in certain circumstances, the range of motion from side-to-side may not be the only limiting factor. In addition to the restraining range of motion, the angle of pursuit and availability of the object from the user's present position may also be a factor in the user's ability to reach and manipulate the object.

One example of the present invention may include a user desiring to loosen or tighten an object that is already connected to another object and is thus limited by its connection to that object. In such an example, the user may require an open-ended wrench to engage the object and perform the initial turning operation. If the object is located in an area where various other objects exist and/or space is limited, the angle of pursuit available to the user to access the object and turn the object with the wrench will also be limited. In such a case, the user may rely on the angled head of the wrench solely to reach the object at an angle where at least some space is available to move the wrench in an effort to loosen and/or tighten the object.

The offset angle "X" may be any common angle associated with wrench design and manufacture. The offset angle may be measured from the planar surface that the wrench is resting on to the center axis of the wrench head. Such an angle provides a slight distance between the handle of the wrench and objects within the nearby periphery of the object to be turned. For example, consider a coaxial cable connected in position to a set top cable television box (STB). Certainly, if the coaxial cable is already connected to the STB then an open-ended wrench is required to loosen the standard six-sided fastener end of the coaxial cable since the cable itself would otherwise be an obstruction to a ratchet or box end wrench.

In such a case where the coaxial cable is screwed into the STB, the open-ended wrench would need a clear path to move the cable end fastener side-to-side in an effort to loosen the cable end fastener. STBs are typically one hardware device among several others (e.g., DVD players, tuners, VCRs, etc.). Furthermore, the stack of hardware devices tend to have abundant amounts of cable connectors to other peripheral devices, such as, the television. An angled wrench head would provide an angle of pursuit outside of the 90 degree angle normally associated with a wrench head and its intended object.

The angle offset "X" may vary in its number of degrees. The angle may be based on any popular industry standard that is often used by mechanics and technicians to loosen and tighten objects that are located in crowded areas. For example, 15 degrees is a popular angle that is often implemented on wrenches to provide a user with some degree of flexibility when attempting to turn the wrench. Such an angle provides a user's hand, wrist and fingers an opportunity to find a comfortable position and angle to manipulate the wrench. Having a speed wrench with the same size on both ends and a same-sized offset angle on both ends provides the user with one wrench that can be used to tighten (using one end) and loosen (using the other end). Regardless of the tightening or loosening motion, the angle offset keeps the hand away from the work area Combining the angle offset with the open-ended box speed wrench teeth and grooves provides the user with an opportunity to not only reach the object effectively, but also to implement the effective speed wrench turning cycle associated with the speed wrench.

While preferred embodiments of the present invention have been described, it is to be understood that the embodiments described are illustrative only and the scope of the invention is to be defined solely by the appended claims when considered with a full range of equivalents and modifications thereto.

What is claimed is:

1. A speed wrench, comprising:

only one recessive portion inside a speed wrench head of the speed wrench;

only one engaging portion inside the speed wrench head; and at least one angled portion providing an angled offset measured from a planar surface that the speed wrench is resting on to the center axis of the speed wrench head, the angled offset as measured from the planar surface to the center axis of the speed wrench head being approximately 15 degrees.

2. The speed wrench of claim 1, further comprising:

a second speed wrench head having at least one recessive portion inside the second speed wrench head of the speed wrench;

at least one engaging portion inside the second speed wrench head; and an additional angled portion providing an angled offset measured from a planar surface that the speed wrench is resting on to the center axis of the second speed wrench head.

3. The speed wrench of claim 2, wherein the at least one recessive portion of the second speed wrench head, the at least one engaging portion of the second speed wrench head, and the additional angled portion of the second speed wrench head are all the same as the respective portions of the first speed wrench head.

4. The speed wrench of claim 2, wherein the speed wrench is an open-ended wrench with an open-ended second speed wrench head.

5. The speed wrench of claim 1, wherein the speed wrench is an open-ended wrench with an open-ended speed wrench head.

6. A speed wrench, comprising:

only one recessive means inside a speed wrench head of the speed wrench for avoiding contact with an object;

only one engaging means inside the speed wrench head for contacting an object; and at least one angled means for providing an angled offset measured from a planar surface that the speed wrench is resting on to the center axis of the speed wrench head, the angled offset as measured from the planar surface to the center axis of the speed wrench head being approximately 15 degrees.

* * * * *